US006378567B1

(12) United States Patent
Chen

(10) Patent No.: US 6,378,567 B1
(45) Date of Patent: Apr. 30, 2002

(54) PLANT FIBER SHADE

(76) Inventor: Yu-Hsiang Chen, No. 105, Sec. 3, Chiehshou Rd., Lukang Chen, Changhua Hsien (TW)

( * ) Notice: Subject to any disclaimer, the term of this patent is extended or adjusted under 35 U.S.C. 154(b) by 0 days.

(21) Appl. No.: 09/963,123

(22) Filed: Sep. 24, 2001

(51) Int. Cl.[7] ..... E06B 3/48

(52) U.S. Cl. ..... 139/383 R; 139/420; 160/231.1; 160/DIG. 7

(58) Field of Search ..... 160/231.1, DIG. 7; 139/420 R, 383 R

(56) References Cited

U.S. PATENT DOCUMENTS 2,244,300 A * 6/1941 Kwon ..... 160/196.1
2,339,113 A * 1/1944 Sarran et al. ..... 160/231.1
2,724,434 A * 11/1955 Smith ..... 160/231.1
6,276,429 B1 * 8/2001 Chen ..... 160/231.1

* cited by examiner

*Primary Examiner*—Andy Falik
(74) *Attorney, Agent, or Firm*—Hedman & Costigan, P.C.

(57) ABSTRACT

A plant fiber shade is composed of multiple twisted slats (10), multiple single strand slats (20), multiple braided slats (30), and multiple weaving threads (40). The slats (10, 20, and 30) are made of plant fibers from different kinds of plants to make the plant fiber shade light, soft and attractive. Additionally, at least two slats (10, 20, and 30) are selectively chosen and arranged in sequence to increase variety of appearances of the plant fiber shade.

4 Claims, 4 Drawing Sheets

PLANT FIBER SHADE

BACKGROUND OF THE INVENTION

1. Field of the Invention

The present invention relates to a shade, and more particularly a plant fiber shade made of multiple plant types with different weaves to create a visually attractive appearance.

2. Description of Related Art

In the art of window shades and decorating, there has long been recognized an area in which it is desirable to shade or otherwise cover a window by desirably decorative means, such as woven wood fabric, together with providing means for holding said shade in a partially or fully raised position. The window shades can be provided at a sufficiently minor expense as to make the assembly adaptable for use in such locations as summer cottages and mountain cabins.

Most of the conventional window shades are made of hard materials such as metal, plastic, wood or bamboo, so as to make the window shades sharp, heavy and cumbersome to use or store. Additionally, variations in appearances of the window shades are limited because the window shade materials are hard and not easily changed.

Therefore, the present invention has arisen to mitigate and/or obviate the disadvantages of the conventional window shades.

SUMMARY OF THE INVENTION

The main objective of the present invention is to provide a plant fiber shade, which has variety in appearance to enhance visual attraction.

A further objective of the present invention is to provide a plant fiber shade that is light and easily stored.

Further benefits and advantages of the present invention will become apparent after a careful reading of the detailed description with appropriate reference to the accompanying drawings.

DETAILED DESCRIPTION OF THE INVENTION

Figure 1:
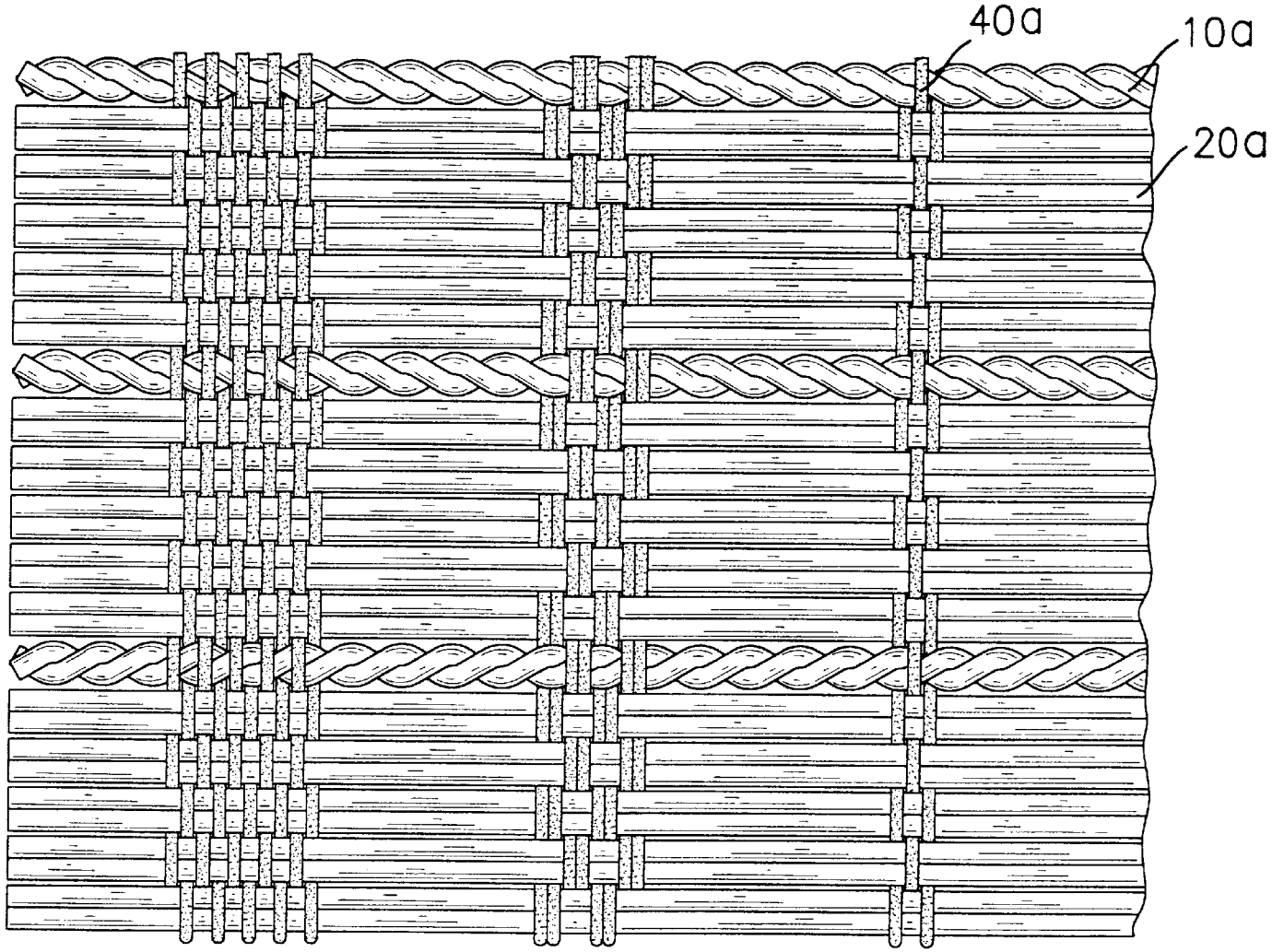
FIG. 1 is a perspective view of a plant fiber shade in accordance with the present invention.

With reference to FIG. 1, a plant fiber shade in accordance with the present invention is made of multiple plant fiber types such as ramie, straw, rush and other similar materials. The plant fiber shade comprises multiple twisted slats (10*a*), at least one single strand slat (20*a*) separating adjacent twisted slats (10*a*) and multiple weaving threads (40*a*). The twisted slats (10*a*) and the single strand slats (20) arranged in a specifically designed sequence are woven together by means of the weaving threads (40*a*) to form the plant fiber shade.

Each twisted slat (10*a*) is made of at least two twisted strands of plant fibers with long stems or ropes made of hemp. Each single strand slat (20*a*) is made of at least one piece or a bundle of straight plant fibers.

Figure 2:
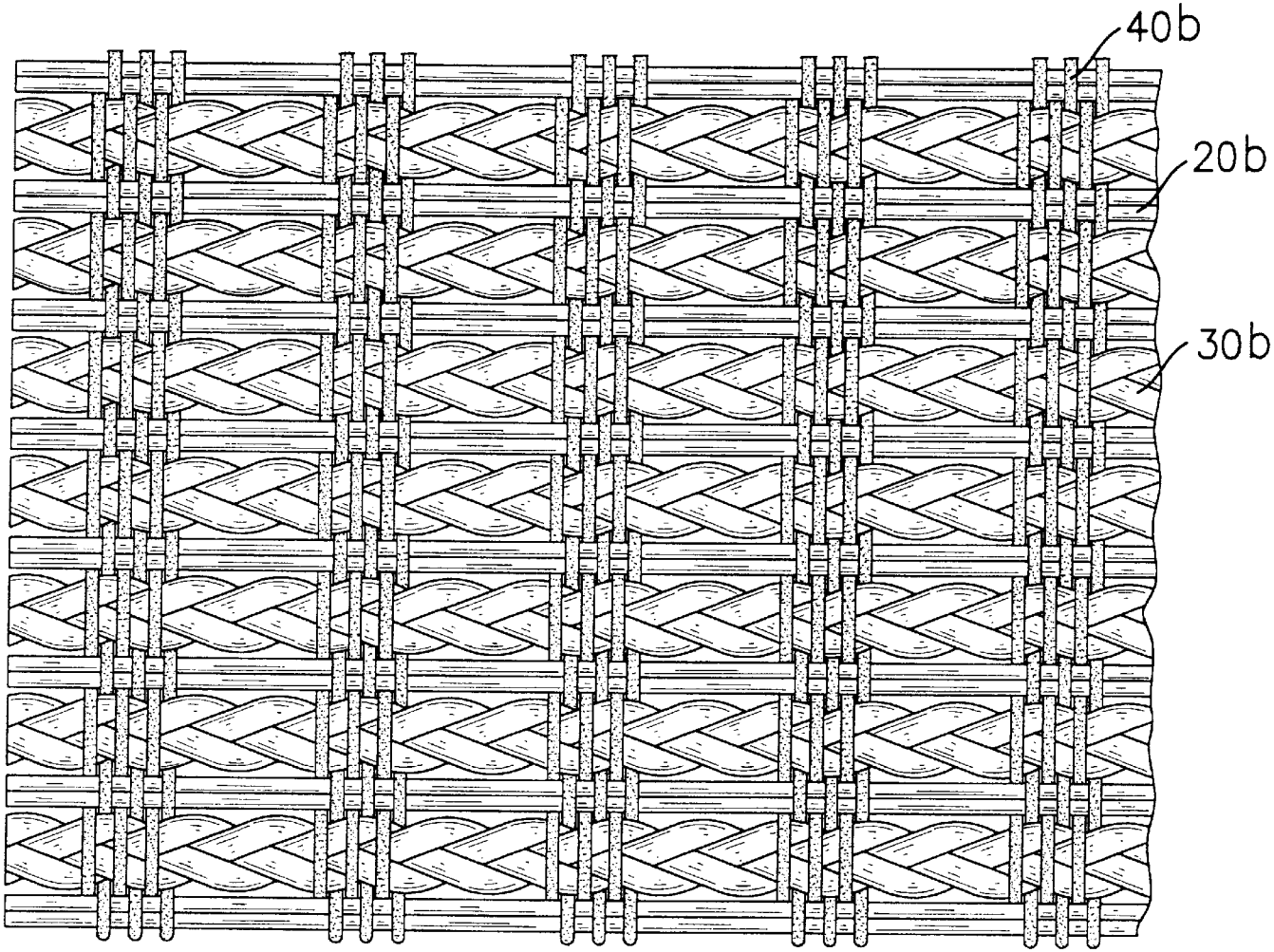
FIG. 2 is a perspective view of an embodiment of the plant fiber shade in accordance with the present invention.

Now with reference to FIG. 2, one embodiment of the plant fiber shade comprises multiple single strand slats (20*b*), multiple braided slats (30*b*) and multiple weaving threads (40*b*). Each braided slat (30*b*) is located between two adjacent single strand slats (20*b*) and then the braided slats (30*b*) are connected to the single strand slats (20*b*) in a regular arrangement by means of the weaving threads (40*b*) to form the plant fiber shade.

Each single strand slat (20*b*) is made of at least one or a bundle of straight plant fibers. Each braided slat (30*b*) is made of at least three twisted fibers of straws or grass or ropes of hemp.

Figure 3:
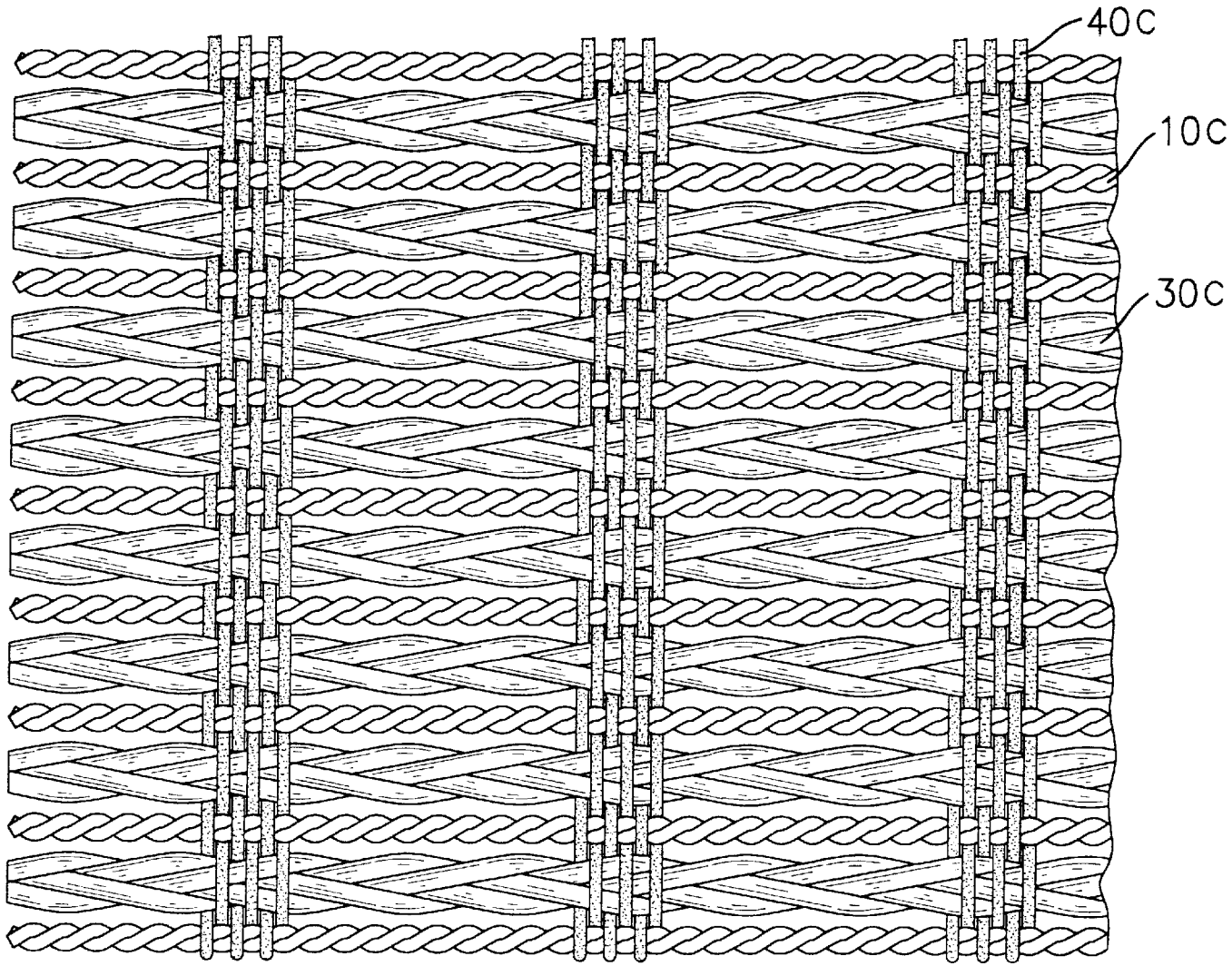
FIG. 3 is perspective view of another embodiment of the plant fiber shade in accordance with the present invention.

With reference to FIG. 3, another embodiment of the plant fiber shade in accordance with the present invention comprises multiple twisted slats (10*c*), multiple braided slats (30*c*), and multiple weaving threads (40*c*). Each braided slat (30*c*) is located between two adjacent twisted slats (10*c*), and then the braided slats (30*c*) and the twisted slats (10*c*) are alternatively arranged and combined by means of the weaving threads (40*c*) to form the plant fiber shade.

Figure 4:
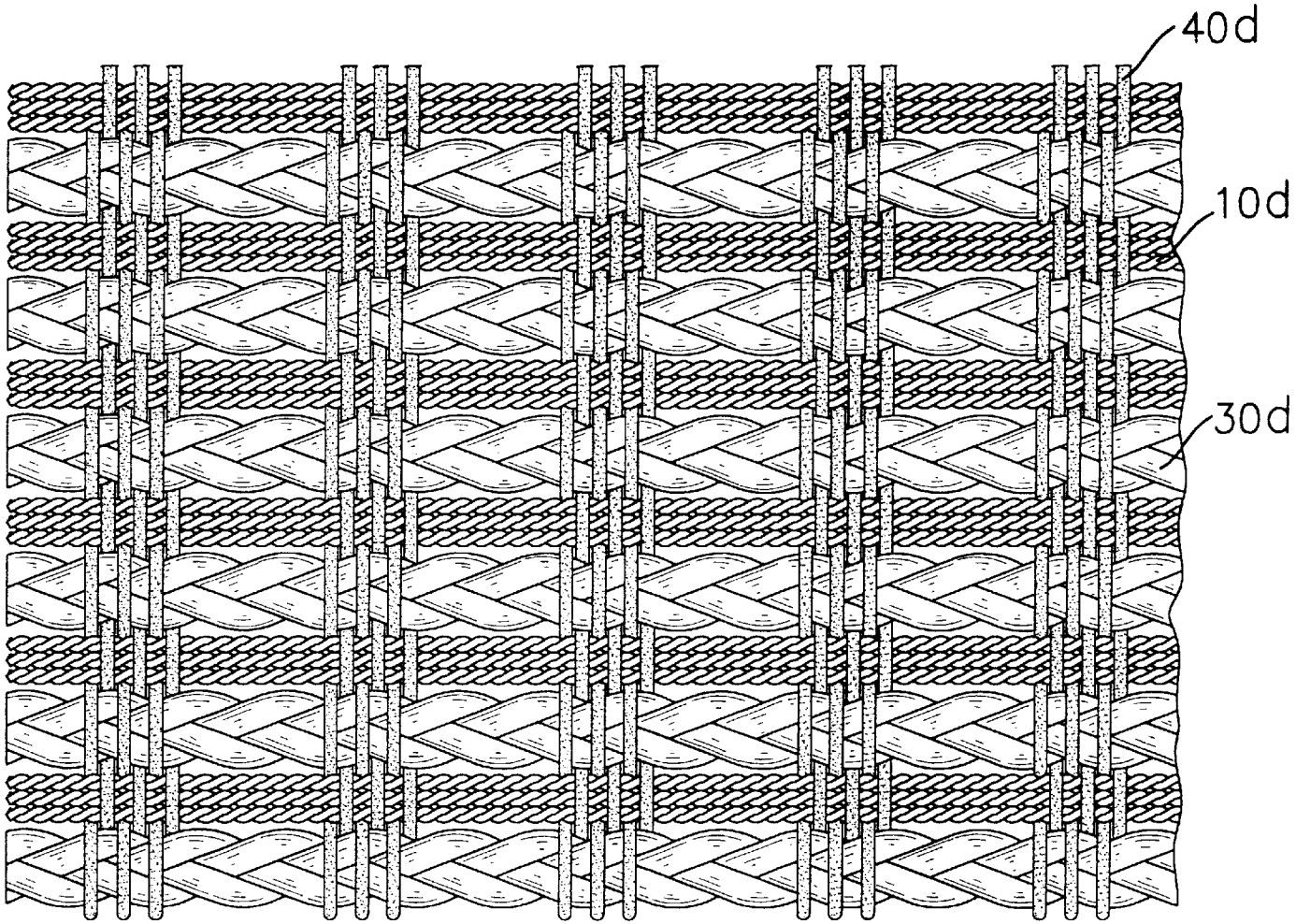
FIG. 4 is perspective view of still another embodiment of the plant fiber shade in accordance with the present invention.

With reference to FIG. 4, still another embodiment of the plant fiber shade in accordance with the present invention comprises multiple twisted slats (10*d*), multiple braided slats (30*d*) and multiple weaving threads (40*d*). At least two twisted slats (10*d*) form a unit, and the unit separates adjacent braided slats (30*d*). The arranged twisted slats (10*d*) in unit and the braided slats (30*d*) are combined by means of the weaving thread (40*d*) to form the plant fiber shade.

According to the foregoing description, it is to be understood that the slats (10, 20, and 30) are made of multiple plant fiber plants without hard and heavy material as used in the conventional window shades. Therefore, the plant fiber shade is soft and light and can be easily used or stored. The slats (10, 20, and 30) are made in a variety of shapes and plant fibers so that the appearance of the plant fiber shade formed by the slats (10, 20, and 30) is versatile and east exotica in decoration.

Although the invention has been explained in relation to its preferred embodiments, it is to be understood that many other possible modifications and variations can be made without departing from the spirit and scope of the invention as hereinafter claimed.

What is claimed is:

1. A plant fiber shade comprising:

multiple twisted slats (10*a*);

at least one single strand slat (20*a*) separating adjacent twists (10*a*); and multiple weaving threads (40*a*) combining the twisted slats (10*a*) and the at least one single strand slat (20*a*) together;

wherein each twisted slat (10*a*) is made of at least two twisted plant fibers, and each single strand slat (20*a*) is made of at least one plant fiber.

2. A plant fiber shade comprising:

multiple single strand slats (20*b*);

multiple braided slats (30*b*) each separating two adjacent single strand slats (20*b*); and multiple weaving threads (40*b*) holding the single strand slats (20*b*) and the braided slats (30*b*) together;

wherein each single strand slats (20*b*) is made of at least one plant fiber and each braided slat (30*b*) is made of at least three twisted plant fibers selectively chosen from the following group: straw, grass, or hemp.

3. A plant fiber shade comprising:

multiple twisted slats (10*c*);

multiple braided slats (30*c*) each separating the adjacent twisted slats (10*c*); and multiple weaving threads (40*c*) connecting the twist slats (10*c*) and the braided slats (30*c*) together;

wherein each twisted slat (10*c*) is made of at least two plant fibers and each braided slat (30*c*) is made of at least three twisted fibers.

4. The plant fiber shade as claimed in claim 3, wherein the twisted slats (10*d*) are grouped together in groups of at least two twisted slats (10*d*) to form a unit and the unit separates adjacent braided slats (30*d*).

* * * * *